US010161732B2

(12) United States Patent
Purkiss

(10) Patent No.: US 10,161,732 B2
(45) Date of Patent: Dec. 25, 2018

(54) TACTICAL MAGNETIC AMMUNITION MAGAZINE

(71) Applicant: Joshua Purkiss, Chicago, IL (US)

(72) Inventor: Joshua Purkiss, Chicago, IL (US)

( * ) Notice: Subject to any disclaimer, the term of this patent is extended or adjusted under 35 U.S.C. 154(b) by 0 days.

(21) Appl. No.: 15/436,840

(22) Filed: Feb. 19, 2017

(65) Prior Publication Data

US 2018/0238671 A1 Aug. 23, 2018

(51) Int. Cl.

| | |
|---|---|
| ***F42B 39/02*** | (2006.01) |
| ***F41A 9/70*** | (2006.01) |
| ***F41A 9/65*** | (2006.01) |
| ***F41C 23/10*** | (2006.01) |

(52) U.S. Cl.

CPC ..... *F42B 39/02* (2013.01); *F41A 9/65* (2013.01); *F41A 9/70* (2013.01); *F41C 23/10* (2013.01)

(58) Field of Classification Search

CPC ..... F41A 9/65; F41A 9/63; F41A 9/61; F41A 9/70; F42B 39/02; F42B 39/002; F42B 39/26

USPC ..... 42/50, 17, 18, 21, 22, 49.01

See application file for complete search history.

(56) References Cited

U.S. PATENT DOCUMENTS

| | | | | | |
|---|---|---|---|---|---|
| 3,938,717 | A * | 2/1976 | Theodore | F41A 9/63 | 224/183 |
| 4,120,109 | A * | 10/1978 | Musgrave | F41A 9/64 | 42/90 |
| D604,794 | S * | 11/2009 | Bentley | F41C 23/10 | D22/109 |
| D642,647 | S * | 8/2011 | Fitzpatrick | D22/108 | |
| 8,793,914 | B2 * | 8/2014 | Anderson | F41A 9/65 | 42/49.01 |
| 9,072,361 | B1 | 7/2015 | Aravena | | |
| 9,459,072 | B2 * | 10/2016 | Kafer | F41C 23/16 | |
| 9,746,299 | B1 * | 8/2017 | Davis | A45F 5/022 | |
| 10,094,636 | B1 * | 10/2018 | Asbury | F41C 23/16 | |
| 2008/0257929 | A1 * | 10/2008 | Cragg | A45F 3/08 | 224/649 |
| 2010/0176173 | A1 * | 7/2010 | Felts | A45F 5/02 | 224/665 |
| 2010/0176174 | A1 * | 7/2010 | Felts | F42B 39/02 | 224/666 |
| 2011/0030257 | A1 * | 2/2011 | Gwillim, Jr. | F41A 9/62 | 42/1.02 |

(Continued)

*Primary Examiner* — John Cooper

(57) ABSTRACT

The Tactical Magnetic Ammunition Magazine provides several unique capabilities for the modern tactical law enforcement or military operator. It has a finger grip located on the forward face of the magazine to allow the shooter to use the magazine as an additional ergonomic gripping location to hold heavier firearms such as rifles. It can quietly be attached to both standard MOLLE vests and forearm gauntlets using magnetic attachment between magnets built into the magazine housing along with magnetic strips separately attached to the MOLLE vest or gauntlet in locations allowing the tactical operator to minimize his reloading time while maintaining noise discipline. The Tactical Magazine Ammunition Magazine further contains a hexagonal closed loop at the bottom end of the magazine to be used both as a shock absorber when firing the firearm in the prone position as well as an ergonomic means to hold the magazine when removing it from the vest or gauntlet to load into the firearm.

6 Claims, 4 Drawing Sheets

(56) References Cited

U.S. PATENT DOCUMENTS

| | | | | |
|---|---|---|---|---|
| 2013/0185979 | A1* | 7/2013 | Fridley | F41C 27/00<br>42/90 |
| 2013/0270311 | A1* | 10/2013 | Sitz | F41A 23/18<br>224/255 |
| 2015/0090750 | A1* | 4/2015 | Coleman | F42B 39/02<br>224/222 |
| 2016/0109208 | A1* | 4/2016 | Bottrell | F41C 27/00<br>42/90 |

* cited by examiner

TACTICAL MAGNETIC AMMUNITION MAGAZINE

FIELD OF THE INVENTION

The present invention relates to ammunition magazines for use with firearms, and more particularly to an ammunition magazine for use in tactical operations where noise discipline, gear configuration and reloading speed are essential to operational success.

BACKGROUND OF THE INVENTION

In the fields of law enforcement and of the military, operators typically store ammunition magazines in magazine holsters. These may be either fabric pockets sewn on the vest, leather or plastic pouches or frictional retention open top carriers. The overwhelming majority of securing methods in the prior art include straps that attach with either Velcro, buttons, frictional retention of "snap in" clips in MOLLE style vests or duty belts. Ammunition magazines in the above mentioned prior art are nearly always secured in either a horizontal or vertical orientation and offer severely limited options in regards to adjustability. While these methods are sufficient in regards to the housing of ammunition, they have several major deficiencies for tactical military and law enforcement operations, especially in regards to covertly conducted operations.

One notable deficiency with ammunition magazine holsters of prior art is that they lack sufficient noise discipline. When a pocket style holster is used, noise is always made when removing the ammunition magazine by unsecuring the security functions of the prior art magazine holders. In the pocket style magazine holders of prior art, these security functions are either made of Velcro, snapping buttons or clips in "click style" buckles. Regardless of the type of securing method used, all prior art methods make a unique sound that is easily recognizable to people whom are ordinarily skilled in the art. A second deficiency is that these prior art methods offer no speed advantage in tactical operations where ammunition reloading time is critical nor do they offer the operator any substantial amount of customizability in location on the body. In fact, the placement of the holsters or ammunition magazines on vests or duty belts are usually designed mainly on aesthetic looks, weight distribution or sheer bulkiness considerations without regard for the tactical considerations such as greatly increasing the operator's customization options and reducing the reloading time of the operator by means of said ergonomic placement of the ammunition magazines. Clearly there is a need for ammunition magazines that can be used for military and tactical law enforcement operators, in particular operators operating in a covert capacity where oppositional forces can at times be close, or at an unknown location, easily alerted by the sounds made from the securing methods of ammunition holders of the prior art. In such circumstances, even a reduction of operational reloading time as small as a nanosecond can make the difference between the operator's success or failure during combat.

BRIEF SUMMARY OF THE INVENTION

It is a first object of the present invention to provide an ammunition magazine that can attach itself, by magnetic means, to protective apparel worn by military and law enforcement personnel such as MOLLE tactical vests.

It is yet another object of the present invention to provide an ammunition magazine that includes forward facing finger grips to provide increased grip and ergonomic advantages for the shooter.

It is a final object of the present invention to provide an ammunition magazine that includes a hexagonal shaped loop and finger pulls for additional impact protection and faster magazine drawing options when using ammunition carrying vests.

DETAILED DESCRIPTION OF THE INVENTION

Figure 1:
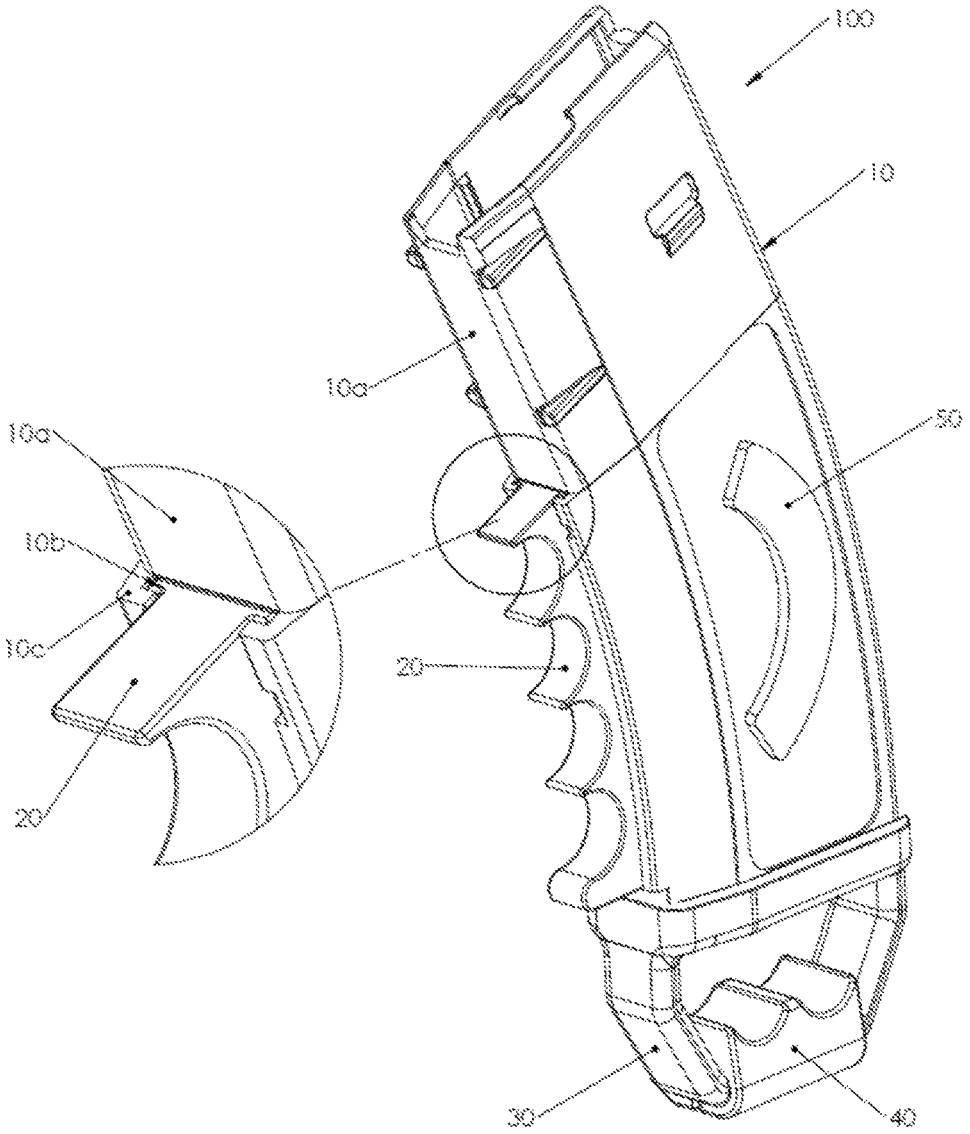
FIG. 1 is a perspective view of the tactical magnetic ammunition magazine

Referring first to FIG. 1, the tactical magnetic ammunition magazine is shown designated by reference numeral 100. The tactical magnetic ammunition magazine consists of a main ammunition magazine housing 10, a finger grip insert 20, a hexagonal loop 30, a finger pull grip 40 and at least one magnetized material 50. The main ammunition magazine housing 10 is similar to traditional ammunition magazines and consists of four walls, an open top, a closed bottom and a spring and follower. As these internal components are standard parts that already exist in prior art magazines, they require no further explanation as to their function. The housing 10 may be made either of injection molded plastic such as nylon or of a metal alloy such as steel.

The finger grip insert 20 is located at the forward facing wall 10*a* of said main housing 10 and has preferably four concave cutouts for the shooter's fingers to fit into for the purpose of providing a gripping means to hold the firearm when the ammunition magazine 100 has been loaded. The preferable method of attachment of the finger grip insert to the housing 10 would be a T shaped protrusion 10*b* at the back end of finger grip 20 that fits into a corresponding channel in the forward wall 10*a* of the main housing 10 formed by the pair of L shaped protrusions 10*c* as shown in the detail view in FIG. 1. An alternative attachment means to attach the grip to the housing (not shown) could be the use of adhesive or fasteners. The preferable material to be used for the finger grip insert 20 is a durable elastomeric rubber.

The hexagonal loop 30 is preferably molded as part of the main housing 10 and not only provides a means to pull the magazine from a tactical vest for fast loading but also to be used as shock protection when the firearm is fired in the prone position. At the bottom end of said loop 30 is attached a small finger grip pull 40 that has preferably two concave cutouts for ergonomic finger grip fit. There is at least one magnetized material 50 attached to at least one side wall as shown. The magnetized material 50 provides a means of rapid attachment and removal from a tactical MOLLE vest equipped with magnetic straps. The shape of the magnetized material 50 may be of any variety of shapes, such as C shaped, L shaped, circular, elliptical, rectangular or square so long as they fit within the perimeter of the side wall as shown in FIG. 1. The thickness of the magnetic material 50 is preferably between 1 and 4 millimeters. The composition of the magnetized material 50 may be any ferromagnetic alloy that has sufficient magnetic force to hold at least 35 pounds of weight. Preferably a stronger ferromagnetic material with rare earth metals such as neodymium (Nd—Fe—B) is preferred. The magnetized material 50 is preferably attached to the main housing 10 by conventional means such as adhesive or fasteners.

Figure 2:
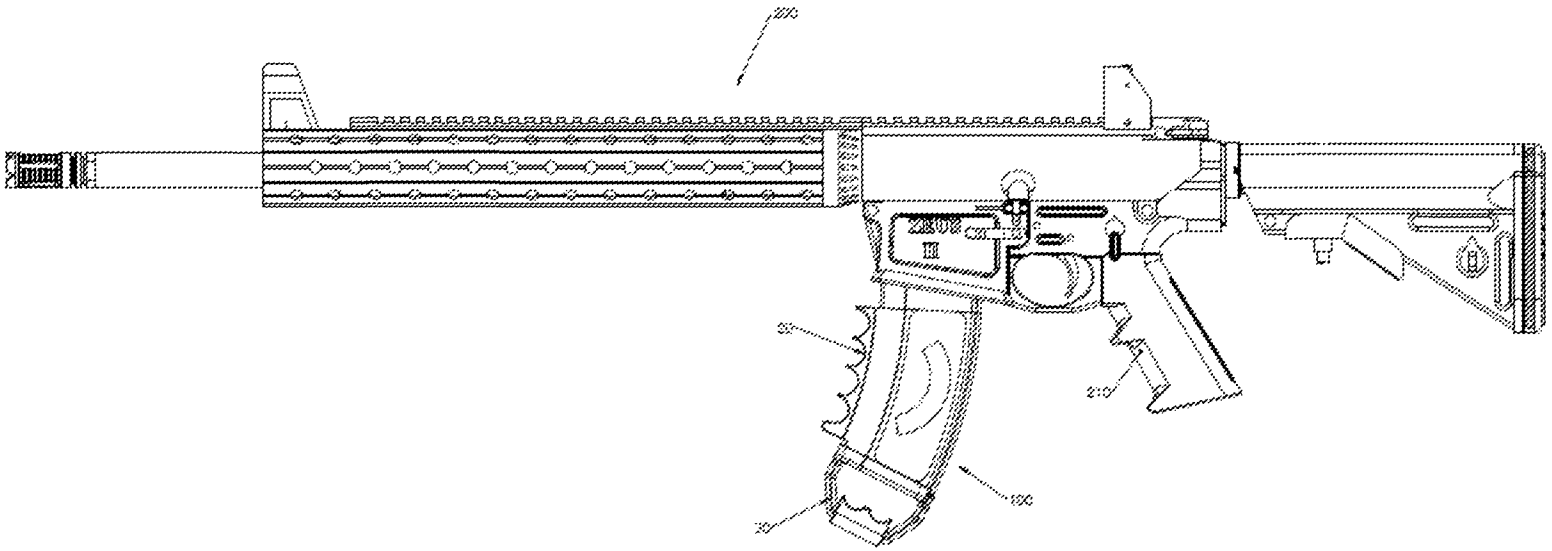
FIG. 2 is a perspective view of an AR-15 rifle shown with a tactical magnetic ammunition magazine loaded

Referring next to FIG. 2, the tactical magnetic ammunition magazine 100 is shown loaded into a firearm 200. Although the firearm shown in FIG. 2 is an AR-15 rifle, the magazine 100 can be designed to accommodate a large variety of other makes and models of firearms. The finger grips 20 can now be used as an additional point to hold the firearm and provides a more stable firing position than holding the barrel of the firearm as in prior art. When the firearm 200 is fired in the prone position, the hexagonal loop 30 of magazine 100 provides a means for shock protection.

Figure 3:
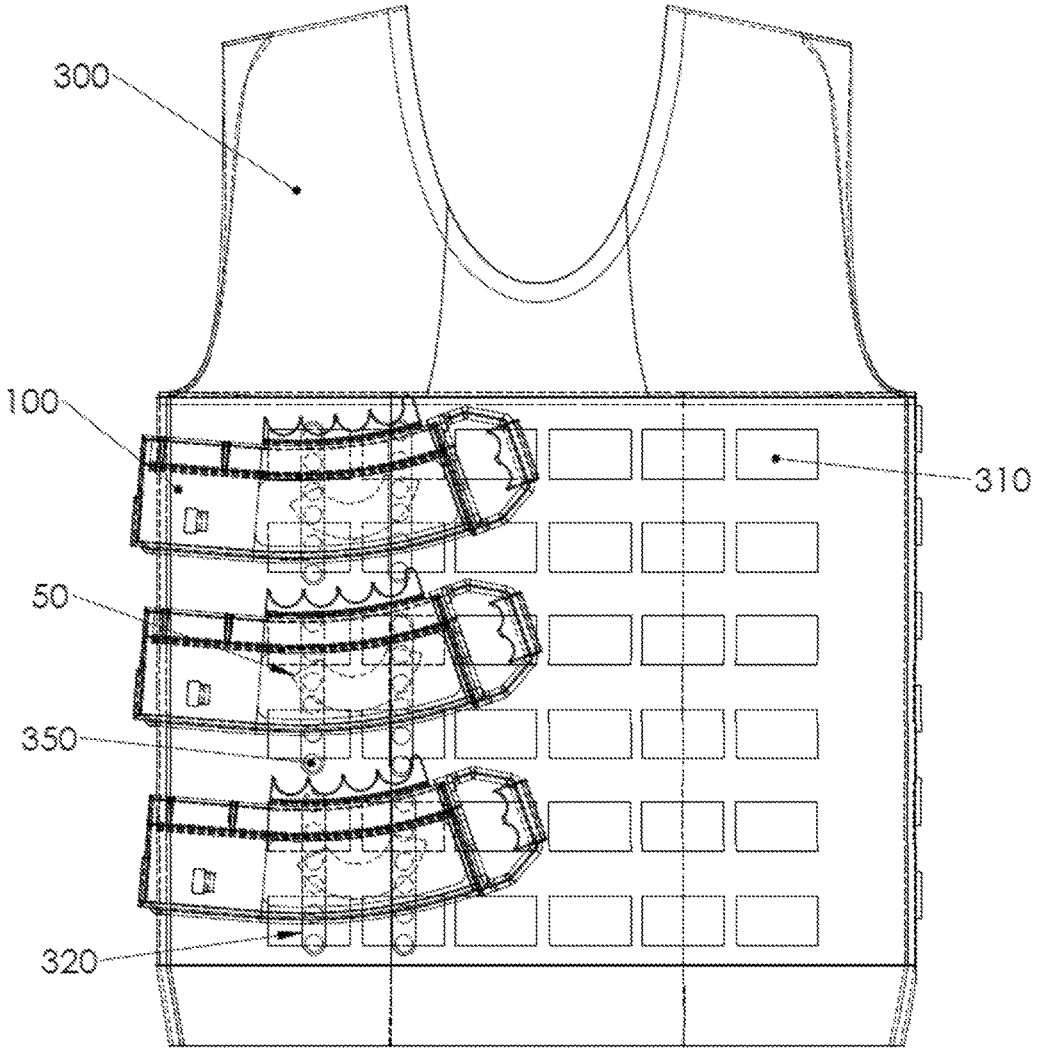
FIG. 3 is a perspective view of a tactical MOLLE vest equipped with magnetic clips and three tactical magnetic ammunition magazines

Referring next to FIG. 3, a tactical style vest 300 commonly used in the law enforcement and military communities known as a MOLLE vest is depicted. These vests commonly are made in a variety of designs, but they all typically have a linear spaced pattern of strap loops 310. These strap loops 310 are typically made of an elastic fabric and sewn into the vest fabric such that the vertical ends are sewn to the vest and the horizontal ends are open for straps to be clipped into. In the preferred embodiment, the operator will can store several magazines 100 on his vest that are magnetically held to magnetic straps 320. Each magnetic strap 320 has preferably between three and six elements of magnetized material 350 fastened to them in an equally spaced fashion as shown. This allows the tactical magnetic ammunition magazine 100 to be oriented to the vest at variable locations and orientations to suit the individual preference of the tactical operator.

Figure 4:
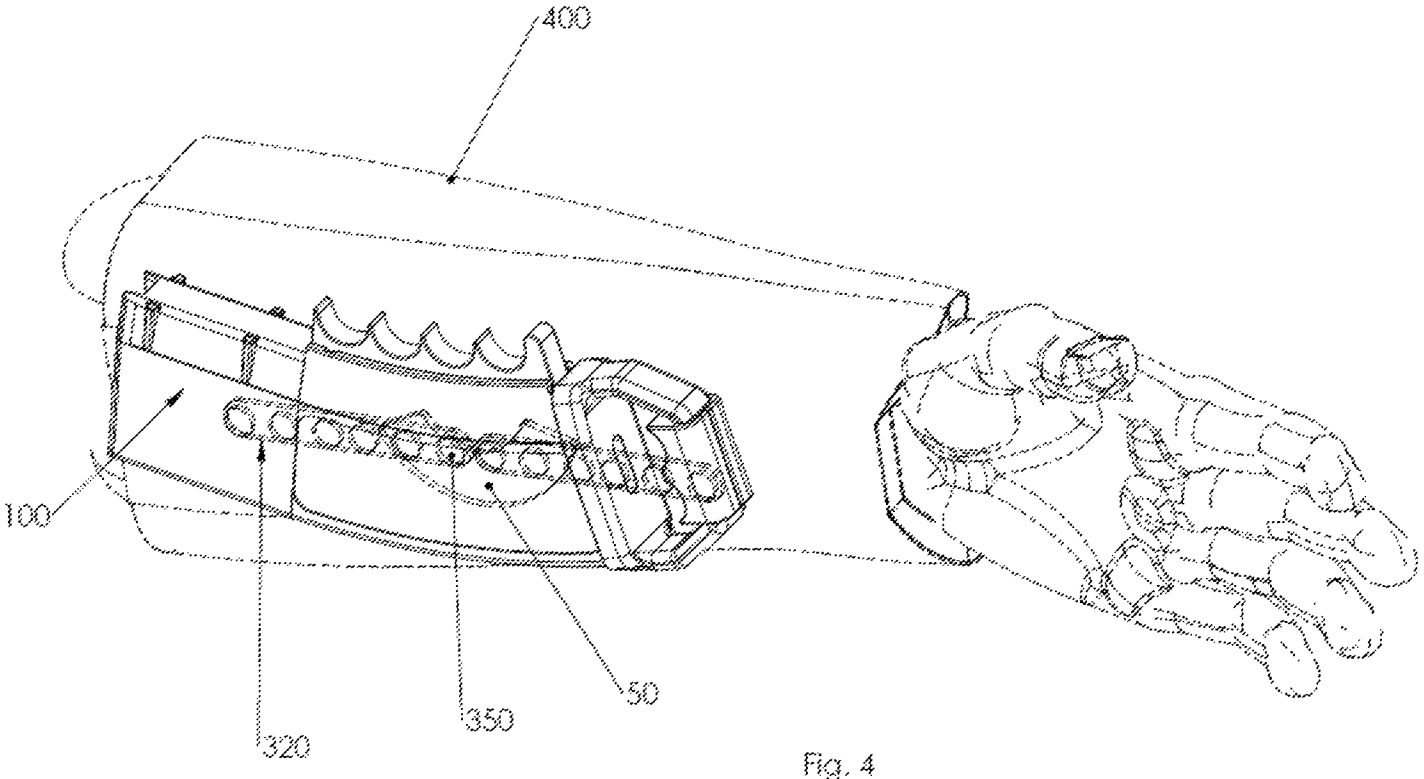
FIG. 4 is a perspective view of an alternative forearm gauntlet with magnetic strips attached to a tactical magnetic ammunition magazine

Referring finally to FIG. 4, an alternative embodiment of carrying the tactical magnetic ammunition magazine 100 on a forearm gauntlet 400 is shown. As in the primary embodiment of a tactical MOLLE vest, the tactical magnetic ammunition magazine 100 requires external magnetized material to attach itself to. In the alternative method of a gauntlet, preferably two magnetic strips 320 are sewn into the main fabric of the gauntlet. Each magnetic strip 320 contains preferably up to six elements of magnetized material 350. This arrangement allows at least one magazine 100 to be attached. Additional magnetic strips 320 may be attached to the gauntlet in order to provide additional locations to store additional magazines 100 as desired. In order to provide a sufficient degree of holding strength the magazine's magnetized material 50 should be in contact with several magnetic strip magnetized material elements 350. The orientation shown would provide a very fast reload time as the operator could pull the magazine 100 off the gauntlet 400 by the finger pull grip located near the hand end of the gauntlet.

What is claimed is:

1. An ammunition magazine for use in firearms comprising:

a magazine housing having a front wall, two side walls, a back wall, a bottom wall, a top opening, a magazine spring, and a follower;

a finger grip insert;

said front wall having a T shaped channel opening along a lower half of said housing configured to attach the finger grip insert;

said finger grip insert having two opposing side tabs running along a back wall of said insert configured to attach to said T shaped channel of said front wall;

said finger grip insert having a plurality of semicircular notches configured for gripping said magazine when attached;

at least one side wall having at least one rigidly attached magnet;

said magazine spring located inside of said magazine housing;

said follower located at said top opening and attached to said magazine spring.

2. The ammunition magazine of claim 1, wherein said magnet on said at least one side wall comprises neodymium.

3. The ammunition magazine of claim 1, wherein said magazine housing comprises thermoplastic.

4. The ammunition magazine of claim 1, wherein said finger grip insert comprises rubber.

5. The ammunition magazine of claim 1, wherein the bottom wall comprises a five sided polygonal shaped protrusion; and a plurality of semicircular notches on the side opposite from and parallel to said bottom wall.

6. The ammunition magazine of claim 5, wherein said five sided polygonal shaped protrusion comprises rubber.

* * * * *